United States Patent [19]

Ehrlich et al.

[11] 4,281,870

[45] Aug. 4, 1981

[54] VEHICLE CONVERTIBLE DOUBLE DECK SYSTEM

[75] Inventors: Donald J. Ehrlich, Monon, Ind.; Bennett O. Blout, Berwyn, Ill.

[73] Assignee: Evans Products Company, Rolling Meadows, Ill.

[21] Appl. No.: 63,922

[22] Filed: Aug. 6, 1979

[51] Int. Cl.[3] ..... B61D 3/02; B61D 3/04; B65D 25/06

[52] U.S. Cl. ..... 296/24 R; 105/372; 105/375; 220/22; 410/121; 410/141; 410/156

[58] Field of Search ..... 105/370, 371, 372, 373, 105/375; 296/24 R, 191, 196; 410/121, 127, 129, 140, 141, 156; 220/22

[56] References Cited

U.S. PATENT DOCUMENTS

| | | | |
|---|---|---|---|
| 2,149,015 | 2/1939 | Giddings | 105/372 |
| 3,477,392 | 11/1969 | Loomis et al. | 410/141 |
| 3,875,871 | 4/1975 | Thornton et al. | 105/375 |
| 3,911,832 | 10/1975 | Vandergriff | 105/372 |

FOREIGN PATENT DOCUMENTS

| | | | |
|---|---|---|---|
| 135751 | 12/1919 | United Kingdom | 410/129 |
| 1167380 | 10/1969 | United Kingdom | 105/375 |

*Primary Examiner*—Joseph F. Peters, Jr.
*Assistant Examiner*—Howard Beltran
*Attorney, Agent, or Firm*—Allegretti, Newitt, Witcoff & McAndrews

[57] ABSTRACT

A deck assembly for a vehicle freight container, e.g., a highway trailer, comprising a series of panels which extend across the container and rest on side rails to provide a second floor for lading spaced above the main floor of the container, the panels being hinged to opposed side walls of the container in a manner to permit storage against the side walls above the side rails. The panels are pivoted at two corners, one pivot being a universal joint and the other being detachable from the side wall to permit the panels to be rotated about both a vertical and a horizontal axis for moving them from stored to operative position and vice versa.

6 Claims, 15 Drawing Figures

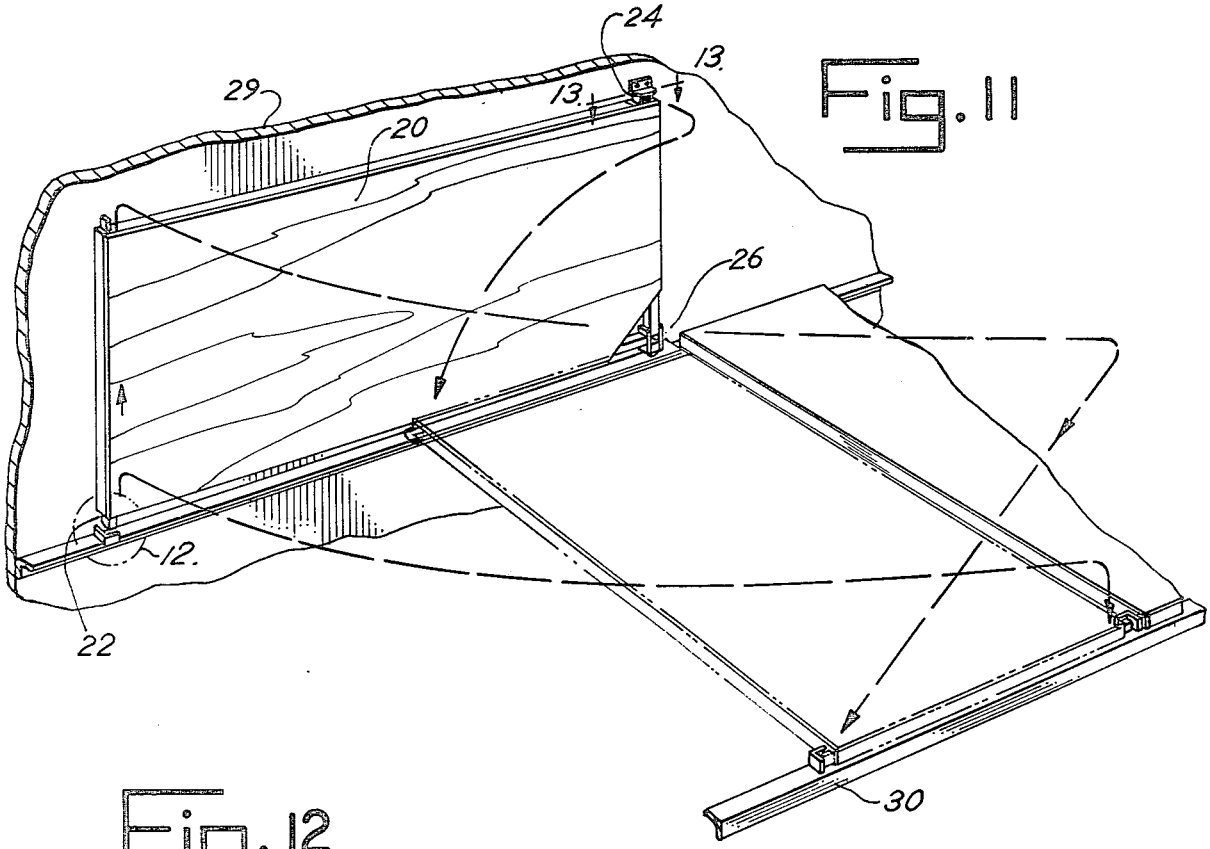
Fig. 11
Fig. 12
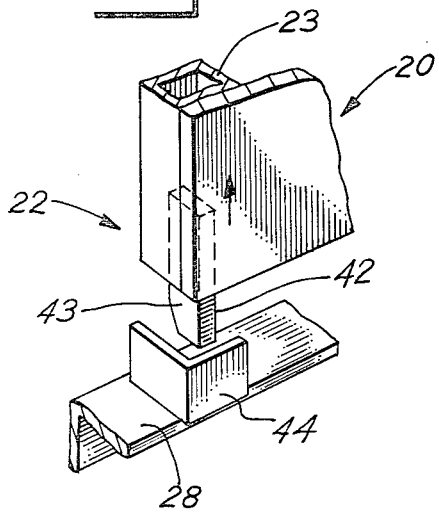
Fig. 13
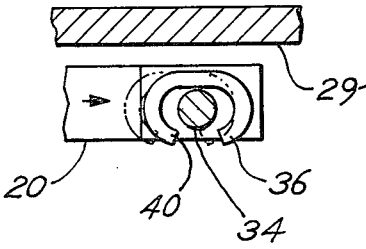
Fig. 14
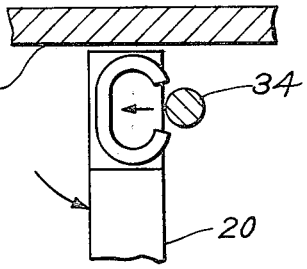
Fig. 15
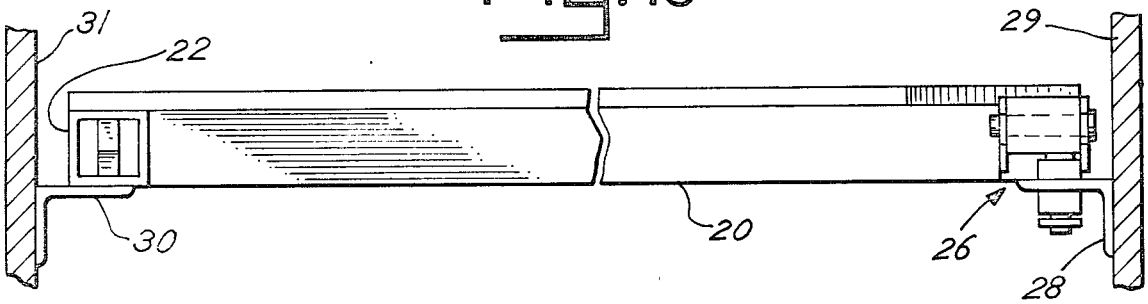

VEHICLE CONVERTIBLE DOUBLE DECK SYSTEM

This invention relates to a deck assembly comprising a series of movable panels mounted inside of a freight container such as a highway trailer, a railroad car, or other vehicle, which can be arranged to provide a second floor space above the main floor of the freight container, or alternatively, stored against the side wall of the container to open the storage space to full height.

PRIOR ART

Deck structures of this type previously have been disclosed as, for example, in U.S. Pat. No. 3,911,832 to Vandergriff. That patent shows a construction in which the panels that extend across the width of the car to form the second floor are made in sections. These sectional panels are mounted on one side wall of the freight container by means of a series of pivoted arms which slide in channels connected to the panel. This construction has a number of disadvantages: the hardware is heavy and cumbersome to handle; the pivoted sliding arms can become misaligned and otherwise damaged during lift-truck loading and unloading of the container; the mechanism requires manual maneuvering and unless great care is taken the workman's hands can be pinched by these scissors-type links. The panels are stored on one wall above and below the side rail which means that the second floor cannot be erected while lading is in the lower portion of the container.

THE INVENTION

It is the object of this invention to obviate these disadvantages and provide an improved deck assembly having single panels extending across the entire width of the freight container rather than sectional panels which require heavy, rigid external support where the panels join each other. The panels are fewer in number and require less hardware.

Another object is to provide movable panels which are hinged to opposed walls of the freight container above the side rails by means of a simple hinge or pivot mechanism and which may be stored, smooth side out, against the upper half of the container.

Another object is to provide movable panels which may be readily maneuvered without heavy lifting and without danger of injury, which have few parts, and are easily maintained.

THE DRAWINGS

These and other objects will become apparent from the following description when read in connection with the accompanying drawings in which FIG. 1 is a perspective view of highway trailer with the top broken away to show the deck panels in stored position;

FIG. 11 is a perspective view of a single panel in storage position and in broken lines in operative position, the arrows indicating the direction in which the panel portions move as the panel is lowered to operative position;

FIG. 12 is an enlarged perspective view of the latch means shown in FIG. 11;

FIG. 13 is a section taken along the lines 13—13 of FIG. 11 with the panel in stored position;

FIG. 14 is a view similar to FIG. 13 with the panel swung away from the wall but still in vertical position;

FIG. 15 is an end view of a panel operative position resting on the opposed side rails of the freight container.

DETAILED DESCRIPTION

Figure 1:
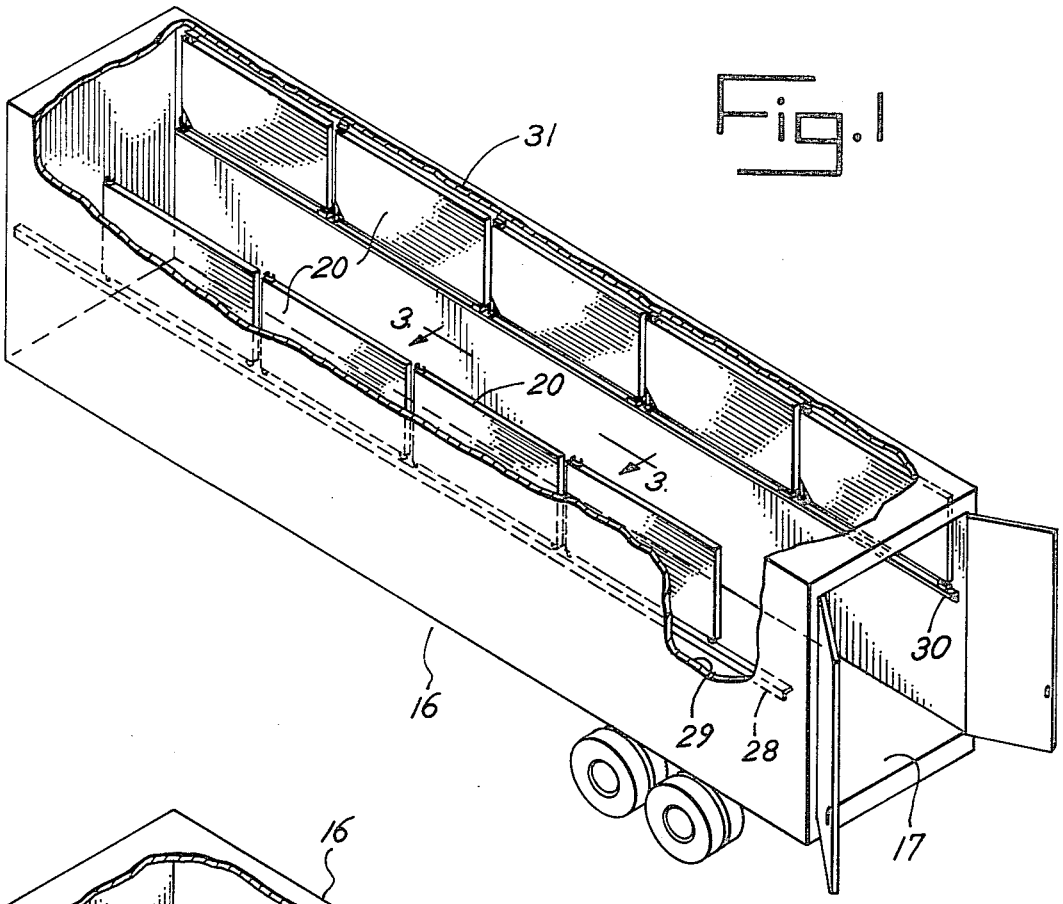
Figure 8:
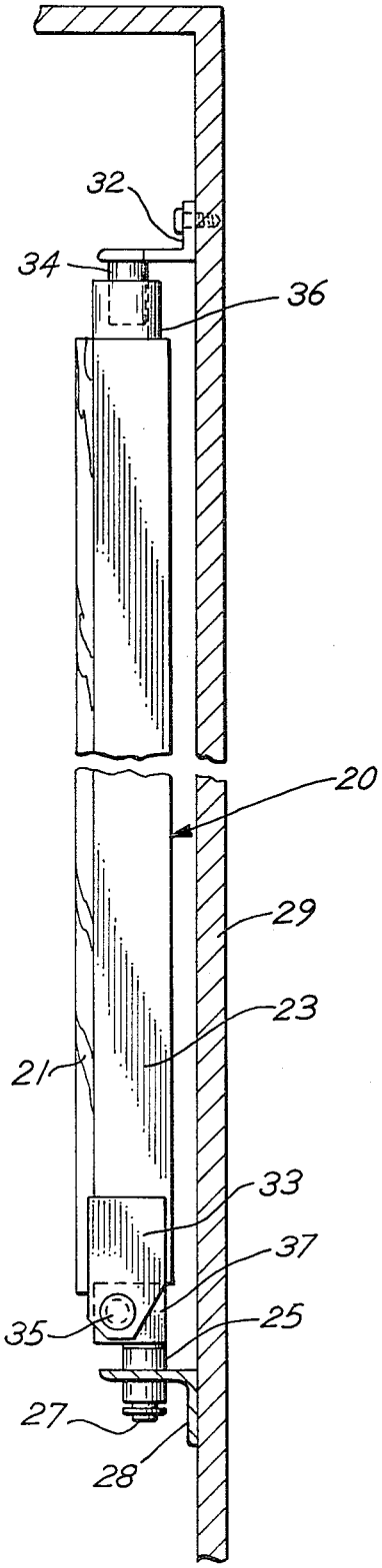
FIG. 8 is a view taken along the line 8—8 of FIG. 3.

Referring to the vehicle of FIG. 1 the panels 20 are shown in stored position against the side walls of the trailer 16. It will be noted that four panels are mounted on the left side and five on the right side looking forward from the doors of the trailer. The panels consist of a frame 23 made from suitable metal members such as tubular, or channel, members and a deck of plywood 21 (FIG. 8). Although the drawings illustrate the invention by means of a highway trailer it will be understood that the invention has use in connection with other freight containers. In this specification the trailer load-carrying compartment will be referred to as a "container".

The panels 20 are all identical in construction except some are hinged from the right and others from the left. The invention will be described with respect to a single panel. Referring to FIG. 3 the panel is hinged at one end in such a manner that it can be rotated or swung out into the container by unlatching the free end. The movement of the panel in being lowered from stored to operative position is illustrated by reference to a panel designated **20*a* shown in broken lines in FIG. 2. This panel is mounted in stored position on the side wall 31 of the freight container. After unlatching the right end of the panel it can be rotated about a vertical axis through the arc A, continuing through the arc B until it extends across the width of the container, still in vertical attitude. In this position the panel can be detached from pivot 24. Pivot 26 permits the panel to rotate about a horizontal axis, the lower edge of the panel, through the arc C and come to rest in horizontal position on the side rails 28, 30. The panels on the left side of the container can be lowered in the same manner and these alternate with those on the right side to provide a solid deck parallel with the floor 17 of the container. The movement of the panels in the manner described is attributable to the construction of the pivot members 24, 26** which will now be described.

Figure 4:
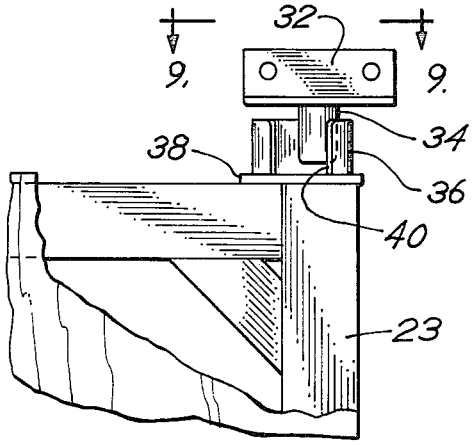
FIG. 4 is an enlarged view of the pivot mounted on the upper right hand corner of the panel shown in FIG. 3.
Figure 7:
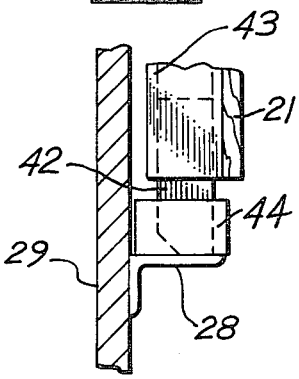
FIG. 7 is a view taken along the line 7—7 of FIG. 5.
Figure 5:
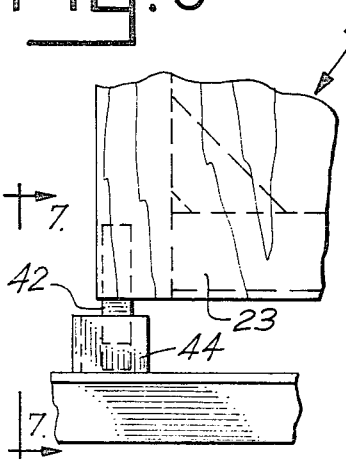
FIG. 5 is an enlarged view of the latch means mounted on the lower left hand corner of the panel shown in FIG. 3.
Figure 9:
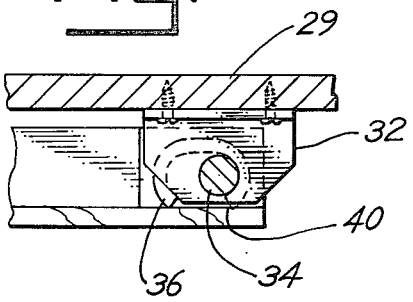
FIG. 9 is a view taken along the line 9—9 of FIG. 4.

Referring to the enlarged view of the upper right hand pivot 24 shown in FIG. 4, a pin 34 extends downwardly from the angle 32 which is secured to the side walls 29 of the container by means of screws or any other suitable fasteners. An elongated ring or sleeve member 36 having a base 38 is welded to the frame 23 of panel 20. The sleeve has a cutout portion or opening 40 in the side facing away from the container wall, as best shown in FIG. 13. The opening is of sufficient width to permit the pin 34 to pass through without difficulty. When the panel is in stored position as shown in FIGS. 8 and 9 the pin 34 remains within the embrace of the sleeve 36 since the panel is prevented by the container wall from moving far enough to permit the pin to pass through the opening 40. Thus the top pivot or hinge in this position holds the panel close to the container wall. Other cooperating elements mounted on the panel and container wall respectively can be used to accomplish the same result.

Figure 6:
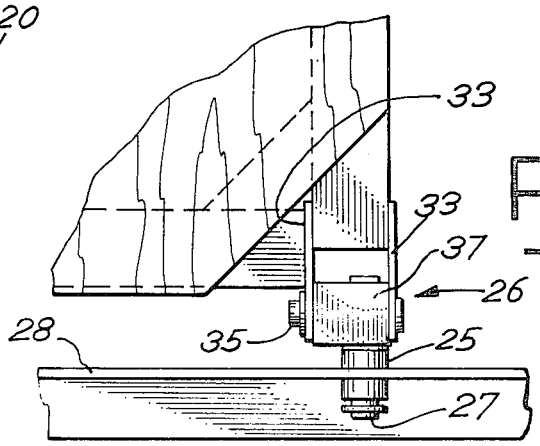
FIG. 6 is an enlarged view of the universal pivot block mounted at the lower right hand corner of the panel shown in FIG. 3.

The lower right hand corner of the panel is secured to the wall 29 by means of a universal pivot block 37 (FIG. 6) which serves as a hinge 26 to permit the panel to swing about both a vertical and a horizontal axis. The panel never becomes detached at this point. The pivot block is secured to the side rail 28 which supports the panel 20. The pivot block is of known construction and comprises a bearing 25 welded to rail 28, in which the vertical clevis pin 27 is fitted. The top of pin 27 slides into an opening in block 37 and permits the panel to swing about a vertical axis. The panel connects to block 37 by means of a pair of links 33. A horizontal clevis pin 35, extending through the links, serves as a horizontal axis about which the panel rotates. Other universal joint structures can be used in place of the one described. It is essential however that the joint allow for rotation about two axes.

The lower left hand corner of the panel carries the latch means indicated generally by the numeral 22. A pin or finger 42 is secured to the frame 23, as best shown in FIG. 12. A keeper 44 consisting of a segment of an angle is welded to the side rail 28. With the panel in stored position the member 42 lies behind the keeper and serves to hold the free end of the panel against the container wall. Pin 42 is placed behind the keeper by lifting the free end of the panel in the direction indicated in FIG. 12. The slight degree of rotation of the panel necessary for this action is permitted (and limited) by the elongated configuration of sleeve 36 at the upper pivot 24. The rotation which occurs at the universal pivot 26 is permitted by the normal clearance between the pins and their holes.

Figure 2:
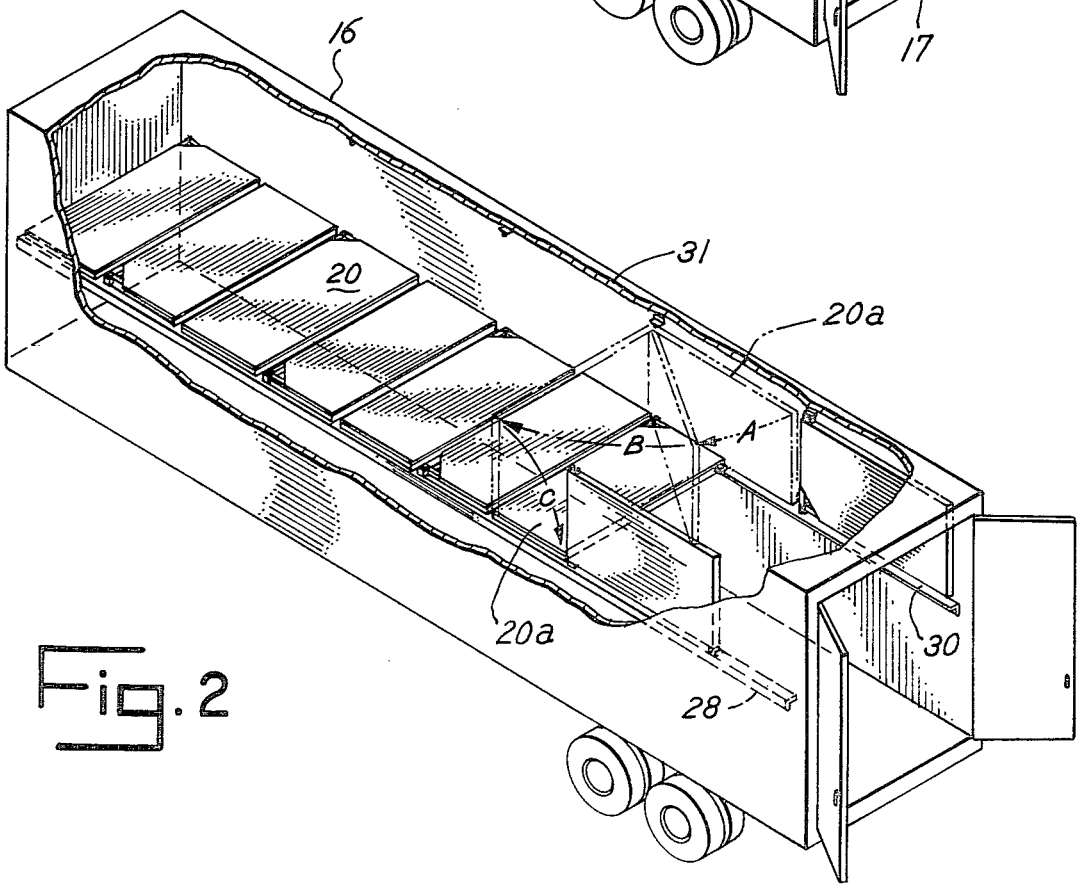
FIG. 2 is a view similar to FIG. 1 in which all the deck panels, except the two nearest the door of the trailer, are in operative position, with the procedure for lowering the panels being illustrated in broken lines.
Figure 3:
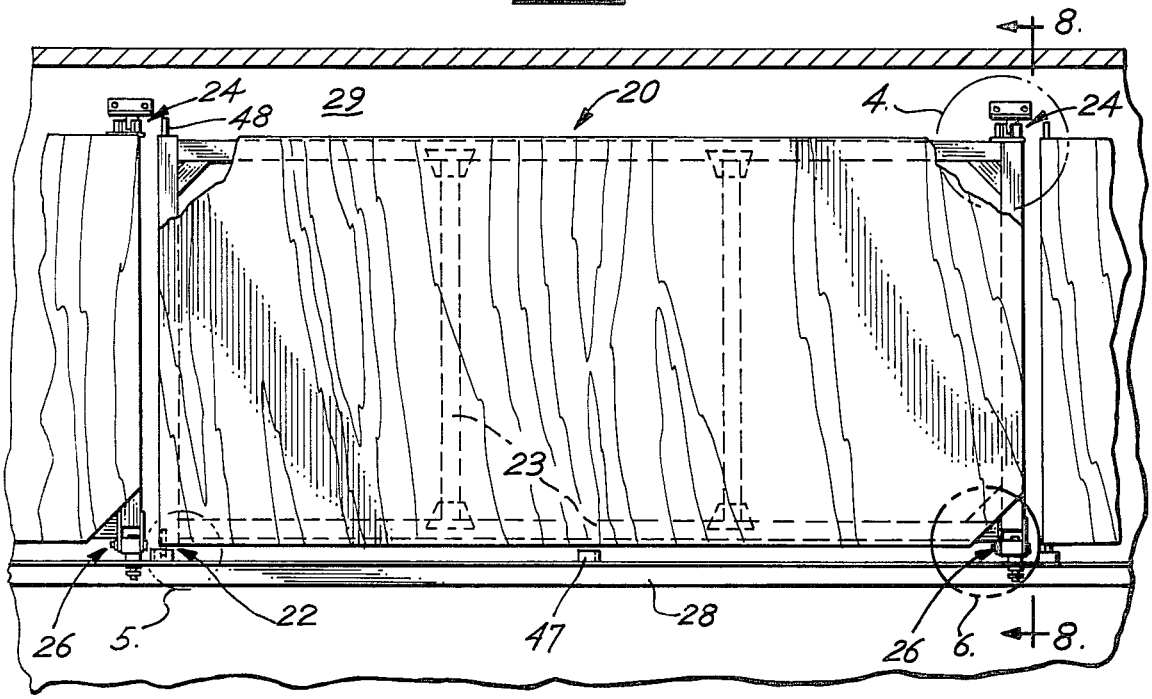
FIG. 3 is an elevational view of the inside face of a portion of the trailer side wall showing one deck panel in storage position, this view being taken along the line 3—3 of FIG. 1.
Figure 10:
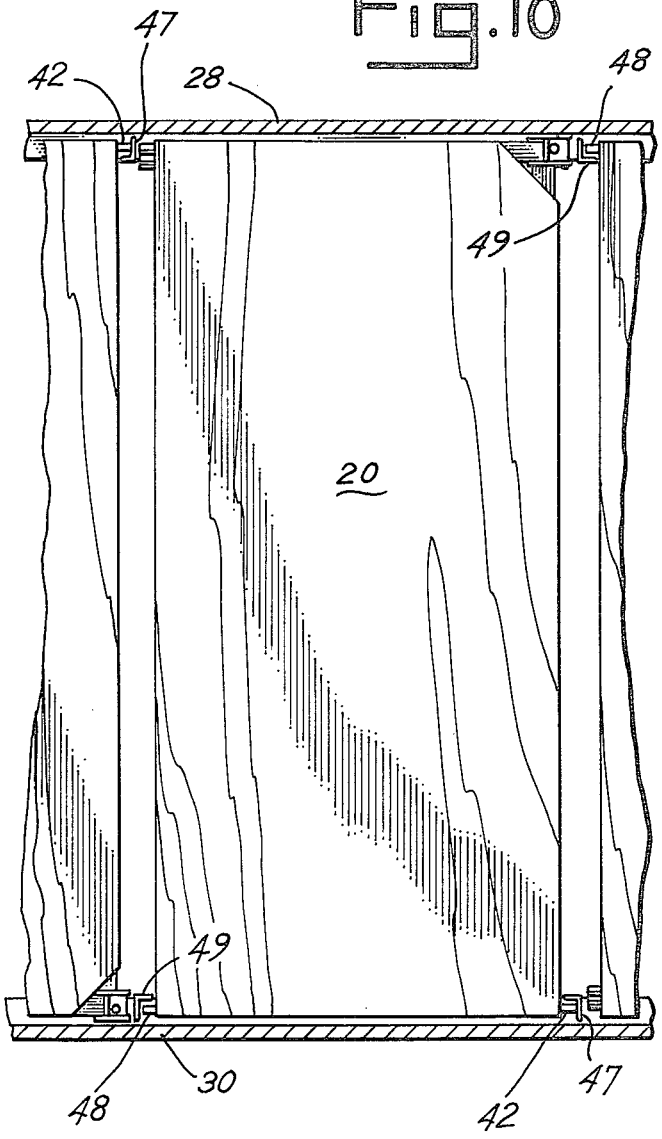
FIG. 10 is a plan view of a panel in operative position, i.e., extending across the width of the container and showing portions of adjacent panels hinged to opposite walls.

Pin 42 also serves as a support for the free end of the panel during rotation through arc C (FIG. 2). In this position the pin 42 abuts against stop 47 welded to the top of rail 30 (FIG. 10). The inclined surface 43 on pin 42 facilitates the turning of the pin against the rail 30 under the weight of the panel.

Pin 42 has a third function. When the panel is in horizontal operative position it lies behind stop 47 and prevents the panel from slipping off the rail 30 should the panel flex due to the imposition of heavy loads. A similar pin 48 at the upper left hand corner of the panel may be provided to insure maintaining the panel in horizontal position. Pin 48 cooperates with stop 49 (FIG. 10) secured to rail 30. It will be understood that like stops are provided along the rails for the cooperating pins on each panel.

The panel is moved from stored position to operative position by manually lifting the free end so that the pin 42 clears the keeper 44, and rotating the free end of the panel 20 through an arc of 90 degrees so it spans the width of the container. The pin 42 then rests on rail 30 behind stop 47 (FIG. 10). When the panel is swung through this 90 degree arc the sleeve 36 of the pivot 24 is also turned from the position shown in FIG. 13 to the position shown in FIG. 14. As the panel moves down to horizontal position in the direction of the arrow the sleeve 36 slides off the pin 34 as shown in FIG. 14. The free end of the panel then rests on the rail 30. The pin 48 is then disposed behind stop 49 and pin 42 is disposed behind stop 47 as shown in FIG. 10.

It will be noted that in moving the panel into operative position the space below the rails is not violated. Thus it is possible to set up the second deck while lading is present in the container below the rails. This is not always possible with previous designs where the panels are stored below the rail line. Storage of the panels above the rails also reduces their vulnerability to damage from lift trucks when the container is being loaded.

To restore the panels the opposite procedure is used. First the panel is tilted about its longitudinal axis to a vertical position. This passes the sleeve 36 through the position shown in FIG. 14 and causes the sleeve 36 to embrace the pin 34. Then the free end of the panel is swung toward the side wall of the container with the panel in a vertical attitude. The sleeve 36 embracing the pin 34 retains the panel in its stored position. As the panel is pushed toward the wall the free end of the panel is manually lifted to place the latch pin 42 behind the keeper 44 to prevent the panel from swinging out into the container.

It will be apparent that the construction of the invention uses minimum of hardware both because of the smaller number of panels and the economy in the design of the attachment mechanism. It also minimizes maintenance and reduces the initial cost of the installation, all significant advantages over the prior art.

It is to be understood that the embodiment of the invention which has been described is merely illustrative of one application of the principles of the invention. Numerous modifications may be made to the disclosed embodiment without departing from the true spirit and scope of the invention.

We claim:

1. In a vehicle freight container having a main floor and a pair of opposed vertical side walls, a deck assembly comprising a series of movable panels for providing a second floor spaced above said main floor, said panels being mounted for storage flat against said side walls, the improvement in mounting means for each panel comprising:

a universal pivot connecting one lower corner of the panel to a container side wall, a second pivot detachably connecting the upper corner of said panel opposite said one lower corner to said container side wall, thereby providing a vertical hinge to permit rotating a free end of the panel across the container adjacent the opposite side wall thereof, said second pivot including means for holding said upper corner in vertical alignment with said lower corner when the panel is disposed against said container side wall and to release said upper corner when the panel is disposed across the container with its free end adjacent said opposite side wall, a pair of horizontally disposed rails secured to said opposed side walls of the container for supporting said panel in operative position at both its free and hinged ends, in parallel spaced relation to the container floor, and means for locking said free end of the panel to said side wall when the panel is in storage position.

2. The deck assembly of claim 1 in which said second pivot comprises a pin and a cooperating sleeve which embraces the pin when the panel is in stored position, a portion of said sleeve being cut out to provide an opening to release said pin when the panel is being lowered to operative position.

3. The deck assembly of claim 2 in which said locking means comprises a latch pin mounted on the panel and a cooperating keeper on the side rail.

4. The deck assembly of claim 2 which includes cooperating members on the free end of the panel and on the rails to prevent said free end from sliding off the rail when the panel is in operative position.

5. The deck assembly of claim 1 in which the panels are mounted longitudinally on opposed side walls of the freight container above the rail line.

6. In a vehicle freight container having a floor, a pair of opposed vertical side walls and a pair of side rails secured to said side walls above the floor, a series of rectangular panels mounted longitudinally on both said side walls above said rails, and hinge means having cooperative members on each panel and on the side wall on which the panel is mounted, which hinge means permit the panels to be rotated about their horizontal and vertical axes, thereby permitting the panels to be moved from a stored position against said side wall on which the panel is mounted to an operative position spanning said side rails to provide a second floor parallel to said container floor.

* * * * *